United States Patent [19]

Sachs et al.

[11] 4,439,480

[45] Mar. 27, 1984

[54] RADIATION CURED COATING AND PROCESS THEREFOR

[75] Inventors: Peter R. Sachs, New Windsor; James W. Sears, Newburgh, both of N.Y.

[73] Assignee: Tarkett AB, Ronneby, Sweden

[21] Appl. No.: 369,752

[22] Filed: Apr. 19, 1982

Related U.S. Application Data

[63] Continuation of Ser. No. 192,587, Oct. 1, 1980, Pat. No. 4,326,001.

[51] Int. Cl.[3] ..... B05D 3/06

[52] U.S. Cl. ..... 428/161; 427/54.1; 204/159.19

[58] Field of Search ..... 427/44, 54.1; 204/159.15; 428/161

[56] References Cited

U.S. PATENT DOCUMENTS

| | | | |
|---|---|---|---|
| 3,293,094 | 12/1966 | Nairn et al. | 428/158 |
| 3,918,393 | 11/1975 | Hahn | 427/44 |
| 4,070,497 | 1/1978 | Wismer et al. | 427/44 |
| 4,122,225 | 10/1978 | Holmstrom et al. | 427/54.1 |
| 4,180,615 | 12/1979 | Bettoli | 428/523 |

*Primary Examiner*—John H. Newsome

*Attorney, Agent, or Firm*—John P. Floyd

[57] ABSTRACT

An article having an opaque, pigmented, radiation cured coating is formed by:

(a) applying to a substrate a thin layer of pigmented radiation curable material and partially curing same with ionizing irradiation or ultraviolet light in an oxygen containing atmosphere; and (b) then applying a second layer of unpigmented radiation curable material over the partially cured first layer and completely curing both the first and second layers with ionizing irradiation or ultraviolet light in an inert atmosphere.

22 Claims, No Drawings

RADIATION CURED COATING AND PROCESS THEREFOR

This application is a continuation of application Ser. No. 192,587, filed Oct. 1, 1980, now U.S. Pat. No. 4,326,001, issued Apr. 20, 1982.

BACKGROUND OF THE INVENTION

Radiation curable coatings for use on a variety of substrates and curable by exposure to ionizing irradiation or ultraviolet light are well known. The use of urethane type coatings cured with ultraviolet light to provide protective wear layers for wall or floor tile is for instance described in U.S. Pat. No. 4,180,615. U.S. Pat. No. 3,918,393 describes a method for obtaining a non-glossy coating on various substrates by curing radiation sensitive material with ionizing irradiation or ultraviolet light in two stages. In this process the coating is partially cured in an oxygen-containing atmosphere and the curing is completed in an inert atmosphere. U.S. Pat. No. 4,122,225 discloses method and apparatus for coating tile which involves the application of one coat of radiation curable material to an entire substrate followed by partial curing and the subsequent application and curing of a second coat of radiation curable material only on high areas of the substrate which are subject to greater than average wear.

Use of pigment in radiation cured coatings on products such as floor covering which are subject to wear during use has presented substantial difficulties. Incorporation of pigment, especially enough pigment to make the coating opaque, makes the coating hard to cure and substantially reduces the thicknesses of coating which can be cured relative to a clear coating cured under the same conditions.

SUMMARY OF THE INVENTION

Product of the invention is a coated article comprising a substrate with two layers of radiation cured coating material adhered thereto. The first layer is a pigmented, preferably opaque layer between 0.01 and about 0.01 millimeter (mm) thick. The second layer is an unpigmented layer, preferably between about 0.01 and about 0.15 mm thick, of the same or a different radiation cured coating material. In a preferred embodiment the wear layers comprise urethane compound photo-polymerized from a fluid coating composition at least two photo-polymerizable ethylenically unsaturated groups of the general structure

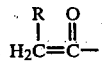

where R is either H or $CH_3$.

The process of the invention is a method of forming a pigmented, radiation cured coating on a substrate comprising:

(a) applying to the substrate a pigmented first layer between about 0.01 and about 0.1 mm thick of radiation curable material and subjecting such layer to ionizing irradiation or ultraviolet light in an atmosphere of at least about 5,000 parts per million (ppm) oxygen until the radiation curable material is cured except for its surface; and (b) then applying to the surface of the thus partially cured first layer an unpigmented second layer of the same or a different radiation curable material and subjecting the second layer as well as at least the surface of the first layer to ionizing irradiation or ultraviolet light in an inert atmosphere containing less than about 1,000 ppm oxygen to thereby complete the cure of the first layer and completely cure the second layer.

DETAILED DESCRIPTION OF THE INVENTION

The invention contemplates the formation of pigmented radiation cured coatings on a wide variety of substrates including such diverse materials as wood, glass, plastics, metals, paper, etc. The invention has particular applicability to tiles and decorative sheet covering material suitable for use on walls and floors, especially vinyl tiles and sheet vinyl.

Radiation curable coatings suitable for use in the invention may in general be selected from any of the coating materials known to be suitable for curing with ionizing irradiation or ultraviolet light. In this respect, ultraviolet light is generally considered to be light having wavelengths in the range from about 2500° A to about 4000° A. The term "ionizing irradiation" is generally considered to include high energy radiation and/or secondary energies resulting from conversion of electrons or other particle energy to x-rays or gamma radiation. While various types of ionizing irradiation are suitable, for instance x-ray or gamma rays, the radiation produced by accelerated high energy electrons generally known as electron beam radiation, has been found to be convenient and economical and to give satisfactory results. Ionizing irradiation equivalent to at least about 100,000 electron volts is generally satisfactory. Ultraviolet light is, however, an especially preferred form of radiation for use in the invention.

As mentioned, the first pigmented coating layer of the invention is between about 0.01 and about 0.1 mm thick and is pigmented and preferably opaque. The second layer is unpigmented and is preferably between about 0.01 and about 0.15 mm thick. The second layer may, except for the lack of pigment, be of the same or a different composition from the first layer.

The overall thickness of the two layers used is generally between about 0.01 and about 0.25 millimeter. With coatings of such thickness, the amount of ionizing irradiation or ultraviolet light is usually between about 0.2 megarad and about 20 megarads in each of the two curing operations involved. The total dosage is frequently between about 0.2 and about 30 megarads or more. In this respect a rad is defined as that amount of radiation required to supply 100 ergs of energy per gram of material treated, and a "megarad" is $10^6$ rads.

In general, any radiation curable coatings may be used in the invention, including those mentioned in the above mentioned U.S. Pat. No. 3,918,393. Preferred coatings are, however, the urethane coatings described in U.S. Pat. No. 4,180,615 wherein the cured coating is formed from a fluid coating composition comprising at least two photo-polymerizable ethylenically unsaturated groups of the general structure:

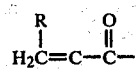

where R is either H or $CH_3$.

Any conventional coating method may be used to apply coatings for use in the invention. Such conventional methods as roll coating, spraying, dip coating and the like are, for instance, suitable for both coatings with roll coating being preferred for the first coating.

In practicing the process of the invention, the first layer of radiation curable coating material is coated onto the substrate and cured by exposure to ionizing irradiation or preferably ultraviolet light in an oxygen containing atmosphere containing at least 5,000 ppm of oxygen. Air is, for instance, a suitable atmosphere for only a partial cure in the sense that the curing is carried out only to the point where the layer is at least gelled and optionally completely cured throughout a portion of its thickness, but in any event only to the point where at least the surface of the first layer remains partially uncured and at least somewhat tacky. Curing of the surface of the first layer is completed at the same time as curing of the second layer.

Following the application and partial curing of the first layer of radiation curable coating material in an oxygen containing atmosphere, a second layer of the same or a different coating is applied to the at least partially uncured first layer in selected areas only and the entire coating, i.e. both layers, is then subjected to completed curing in an inert atmosphere containing less than about 1,000 ppm oxygen and frequently less than about 250 ppm oxygen. Gases such as nitrogen, helium, etc. are for instance suitable for providing the inert atmosphere.

For a better understanding of suitable substrates and radiation curable coatings, as well as techniques for curing such coatings and making tiles having radiation cured coatings, reference may be had to U.S. Pat. Nos. 3,918,893, 4,122,225, 4,180,615 and 3,293,094 the disclosures of which are incorporated.

Viscosity of radiation curable coatings used in the invention may vary widely depending upon the particular coating technique employed. In a preferred embodiment in which roll coating is used, the viscosity is preferably between about 1,000 and about 5,000 centipoises (cp) at 77° F.

Various conventional additives for radiation curable coatings may of course be present in coatings of the invention. These include such materials as fillers, dyes, thermoplastic additives, plasticizers, synthetic resins, heat and light stabilizers, photo-initiators, filler such as carbon black, glass fibers, silica, etc.

Coating compositions for use in the invention are preferably substantially free of non-reactive solvent, i.e. contain no more than about 5 wt % solvent. Total inactive ingredients, such as the additives and non-reactive solvent mentioned above, where used, are preferably present in amounts of no more than 10 wt %.

Where the preferred urethane type coating compositions described above are used and cured by ultraviolet, photo-sensitizers are generally employed in amounts between about 0.5 to about 5% by weight of the composition. Such preferred composition also preferably includes one or more mono or di-functional vinyl monomers, copolymerizable under ultra violet radiation with the above indicated urethane compounds used in the coating composition. The monomer functions to reduce the viscosity of the compound and is preferably of low vapor pressure to prevent evaporative loss during application and curing. The monomer must also be sufficiently stable to prevent premature gellation or reaction with the urethane compounds prior to exposure to ultraviolet light for curing of the coating. If desired, small amounts of polymerization inhibitors may be added for this purpose. Suitable monfunctional monomers include, for instance, acrylates or methacrylates having the formula:

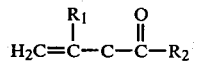

where $R_1$ is H or $CH_3$ and $R_2$ is an alkyl or cycloalkyl group having 6 to 18 carbon atoms, a phenozylalkyl groups of 6 to 18 carbons or hydroxyalkyl group. Suitable monomers are described in greater detail in the above-mentioned U.S. Pat. No. 4,180,615.

The following example is intended to illustrate the invention without limiting the scope thereof.

EXAMPLE

A clear acrylo-urethane (Glidden 879-C-567) coating was tinted with 1% of a matched pigmented dispersion of three individual pigmented dispersions. The matched color concentrate was dark brown.

The tinted coating was fed into a first direct roll coater. An untinted coating of the same composition as the tinted coating was fed into a second direct roll coater.

The substrate used was conventional tile base about 80 mils thick printed and embossed to look like a red brick pattern. This substrate was then coated with the first coating, so that all of the sheet was covered by the tinted coating with enough pressure to leave puddles in the embossed valleys but wiped off the tops. The substrate temperature at the first roll coater was about 160°-170° F.

The coated sheet was then passed under a first source of UV radiation in an air atmosphere which cured the lower layers of the tinted coating and partially cured the exposed surface of the tinted coating, leaving it tacky so that when the sheet was now passed through the second direct roll coater (which applied about 2 mils of untinted coating) this coating adhered to it. The sheet was next passed under a second source of UV radiation, but in a nitrogen inerted atmosphere, where both coatings applied were completely cured.

While the invention has been described above with respect to certain embodiments thereof, it will be appreciated that various changes and modifications may be made without departing from the spirit and scope of the invention.

What is claimed is:

1. Method of forming a pigmented, radiation cured coating on a substrate comprising:

(a) applying to the substrate a pigmented first layer between about 0.01 and about 0.1 mm thick of radiation curable material and subjecting such layer to ionizing irradiation or ultraviolet light in an atmosphere containing at least about 5,000 ppm oxygen until the radiation curable material is cured except for its surface; and (b) then applying to selected areas of the surface of the thus partially cured first layer an unpigmented second layer of the same or a different radiation curable material and subjecting the second layer to ionizing irradiation or ultraviolet light in an inert atmosphere containing less than about 1,000 ppm oxygen to thereby completely cure said second layer and complete the cure of the first layer.

2. Method according to claim 1 wherein radiation curable material of said first and second layers is substantially solvent free and the first layer is opaque.

3. Method according to claim 1 wherein the coating material used for said layers of material comprises in each case fluid urethane compound containing at least two photo-polymerizable, ethylenically unsaturated groups of the general structure:

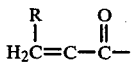

4. Method according to claim 1 wherein each of steps (a) and (b) includes subjecting the radiation curable material to ultraviolet light until a radiation dosage between about 0.2 and 20 megarads has been received by the material.

5. Method according to claim 1 wherein (a) radiation curable material of said first and second layers is substantially free of non-reactive solvent;

(b) the coating material used for said layers of material comprises in each case fluid urethane compound containing at least two photo-polymerizable, ethylenically unsaturated groups of the general structure:

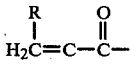

where R is either H or $CH_3$ and (c) each of steps (a) and (b) of claim 1 includes subjecting the radiation curable material to ultraviolet light until a radiation dosage between about 0.2 and about 20 megarads have been received by the material.

6. Method according to claim 5 wherein the substrate is vinyl tile base material or sheet vinyl material.

7. Method according to claim 1 wherein the second layer is between about 0.01 and about 0.15 mm thick and the first layer is opaque.

8. A coated article formed by the method of claim 1.

9. A coated article comprising a substrate, suitable for use in a floor covering product having two layers of radiation cured coating adhered thereto, the first layer being a pigmented layer between about 0.01 and about 0.1 mm thick and the second layer being an unpigmented layer adhered to and overlying the first layer.

10. A coated article according to claim 9 wherein the second layer is between about 0.01 and about 0.15 mm thick and the first layer is opaque.

11. The coated article of claim 9 wherein the substrate is embossed in a decorative pattern and wherein the first pigmented layer is thicker in the valleys defined by the embossing than on the tops of the embossing.

12. The coated article of claim 9, wherein the second layer overlies and adheres to the first layer in selected areas only.

13. The coated article of claim 9 wherein the composition of the second layer is, except for the lack of pigment, the same as the first layer.

14. The coated article of claim 9 wherein the composition of the second layer is, in addition to the lack of pigment, different from the first layer.

15. The coated article of claim 9 wherein the second layer comprises a urethane compound photopolymerized from a fluid coating composition comprising at least two photo-polymerizable ethylenically unsaturated groups of the general structure:

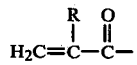

where R is either H or $CH_3$.

16. The coated article of claim 9 wherein the substrate is vinyl tile base material or sheet vinyl material.

17. The coated article of claim 11 wherein the substrate is vinyl tile base material or sheet vinyl material.

18. The coated article of claim 11 formed by applying the first layer to the substrate by roll coating and the second layer by curtain coating.

19. Method of forming an article having a pigmented, radiation cured coating comprising:

(a) applying to a substrate, suitable for use in a floor covering product, a first layer of pigmented radiation curable material;

(b) then applying a second layer of unpigmented radiation curable material over the first layer, which is at least partially uncured prior to such application, and (c) completely curing both the first and second layers with ionizing irradiation or ultraviolet light.

20. The method of claim 19 wherein the first layer is between about 0.01 and about 0.1 mm thick and the second layer is between about 0.01 and about 0.15 mm thick.

21. Method of forming a pigmented, radiation cured coating on a substrate of embossed tile base or sheet material, each suitable for floor covering, comprising:

(a) applying to the substrate a thin first layer of pigmented, radiation curable material, said layer being applied onto the substrate so that all of the substrate is covered by the coating and with enough pressure to leave puddles of coating material in the embossed valleys of the substrate, (b) then applying a thin second layer of unpigmented, radiation curable material over the first layer which is at least partially uncured prior to such application, and (c) completely curing both the first and second layers with ionizing irradiation or ultraviolet light.

22. The method of claim 21 wherein the first layer is between about 0.01 and about 0.1 mm thick and the second layer is between about 0.01 and about 0.15 mm thick.

* * * * *

UNITED STATES PATENT AND TRADEMARK OFFICE

CERTIFICATE OF CORRECTION

PATENT NO. : 4,439,480

DATED : March 27, 1984

INVENTOR(S) : Peter R. Sachs and James W. Sears

It is certified that error appears in the above-identified patent and that said Letters Patent is hereby corrected as shown below:

Column 1, line 43 after "about", delete "0.01", insert --0.1--.

Column 1, lines 50-54 and Column 2, lines 63-67
Amend the structural formula to read $$H_2C = \overset{R}{\overset{|}{C}} - \overset{O}{\overset{\|}{C}} -$$

Column 4, lines 6-10
Amend the structural formula to read $$H_2C = \overset{R_1}{\overset{|}{C}} - \overset{O}{\overset{\|}{C}} - O - R_2$$

Claim 3, Column 5, lines 11-13 and Claim 5, Column 5, lines 27-31
Amend the structural formula to read $$H_2C = \overset{R}{\overset{|}{C}} - \overset{O}{\overset{\|}{C}} -$$

Signed and Sealed this

Eleventh Day of September 1984

[SEAL]

Attest:

GERALD J. MOSSINGHOFF

Attesting Officer

Commissioner of Patents and Trademarks